US007007685B2

(12) United States Patent
Ichihashi

(10) Patent No.: US 7,007,685 B2
(45) Date of Patent: Mar. 7, 2006

(54) AIR-FUEL RATIO CONTROL DEVICE OF INTERNAL COMBUSTION ENGINE

(75) Inventor: Satoshi Ichihashi, Kakuda (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/515,017

(22) PCT Filed: Apr. 12, 2004

(86) PCT No.: PCT/JP2004/005214

§ 371 (c)(1),
(2), (4) Date: Nov. 22, 2004

(87) PCT Pub. No.: WO2004/106720

PCT Pub. Date: Dec. 9, 2004

(65) Prior Publication Data

US 2005/0211234 A1 Sep. 29, 2005

(30) Foreign Application Priority Data

May 30, 2003 (JP) ..... 2003-154236

(51) Int. Cl.
*F02D 41/00* (2006.01)

(52) U.S. Cl. ..... 123/703; 123/683

(58) Field of Classification Search ..... 123/672, 123/681, 687, 696, 703, 683
See application file for complete search history.

(56) References Cited

U.S. PATENT DOCUMENTS 6,065,445 A * 5/2000 Motose et al. ..... 123/305
6,119,453 A * 9/2000 Motose et al. ..... 60/285

FOREIGN PATENT DOCUMENTS

| | | |
|---|---|---|
| JP | 03-111647 | 5/1991 |
| JP | 8-177571 | 7/1996 |
| JP | 2002/147236 | 5/2002 |
| JP | 2002/285900 | 10/2002 |

* cited by examiner

*Primary Examiner*—Mahmoud Gimie
(74) *Attorney, Agent, or Firm*—Westerman, Hattori, Daniels & Adrian, LLP.

(57) ABSTRACT

An air-fuel ratio control apparatus for controlling an air-fuel ratio of a supplied air-fuel mixture of an internal combustion engine to a target air-fuel ratio by a feedback control in accordance with an output signal of an oxygen concentration sensor provided at an exhaust pipe of the internal combustion engine, in which a perturbation control for vibrating the air-fuel ratio periodically to a rich side and a lean side centering on the target air-fuel ratio is executed in accordance with the output signal of the oxygen concentration sensor in a predetermined high load and high rotation operating state of the internal combustion engine.

7 Claims, 9 Drawing Sheets

AIR-FUEL RATIO CONTROL DEVICE OF INTERNAL COMBUSTION ENGINE

TECHNICAL FIELD

The present invention relates to an air-fuel ratio control apparatus provided to an internal combustion engine for reducing an uncombusted component in exhaust gas.

BACKGROUND ART

In an internal combustion engine, there is provided an air-fuel ratio control apparatus for detecting an oxygen concentration in exhaust by an oxygen concentration sensor provided at an exhaust system for reducing an uncombusted component in exhaust gas and controlling an air-fuel ratio of an air-fuel mixture to an engine to a target air-fuel ratio near to the stoichiometric air-fuel ratio by a feedback control in accordance with the detected oxygen concentration.

Further, in an exhaust system of an internal combustion engine, normally, a catalyzer using a three way catalyst is provided. The catalyzer is provided with a function of simultaneously reducing CO, HC, and NOx in exhaust gas at a near stoichiometric air-fuel ratio.

In the case of a vehicle having a light weight of a motorcycle or the like in which an engine is comparatively frequently used in a high rotational speed region or a high load region, it is known that an amount of NOx in exhaust gas is large. However, there poses a problem that a cleaning rate of NOx by a catalyzer in using an air-fuel ratio control apparatus of a background art having a system of converging an air-fuel ratio near to the stoichiometric air-fuel ratio, is very low in comparison with cleaning rates of other components of CO, HC and a reduction in NOx cannot sufficiently be achieved.

DISCLOSURE OF INVENTION

It is an object of the invention to provide an air-fuel ratio control apparatus capable of sufficiently reducing not only CO, HC but also NOx in exhaust gas of an internal combustion engine mounted to a vehicle in which the engine is comparatively frequently used in a high rotation region or a high load region.

An air-fuel ratio control apparatus of an internal combustion engine according to the invention is an apparatus including an oxygen concentration sensor for generating an output signal depending on an oxygen concentration in exhaust gas at an exhaust pipe of an internal combustion engine, for controlling an air-fuel ratio of an air-fuel mixture to be supplied to the internal combustion engine in accordance with the output signal of the oxygen concentration sensor to a target air-fuel ratio by a feedback control, the air-fuel ratio control apparatus comprising: detecting means for detecting a predetermined high load and high rotation operating state of the internal combustion engine to generate a detecting signal; and controlling means for executing a perturbation control for vibrating the air-fuel ratio periodically to a rich side and a lean side centering on the target air-fuel ratio in accordance with the output signal of the oxygen concentration sensor when the detecting signal is generated.

As a result, the perturbation control is executed in the predetermined high load and high rotational speed region in which an amount of exhausting NOx is increased and not only CO, HC but also NOx in the exhaust gas can sufficiently be reduced.

DETAILED DESCRIPTION OF THE INVENTION

Hereinafter, an embodiment of the invention will be explained in details in reference to the drawings.

Figure 1:
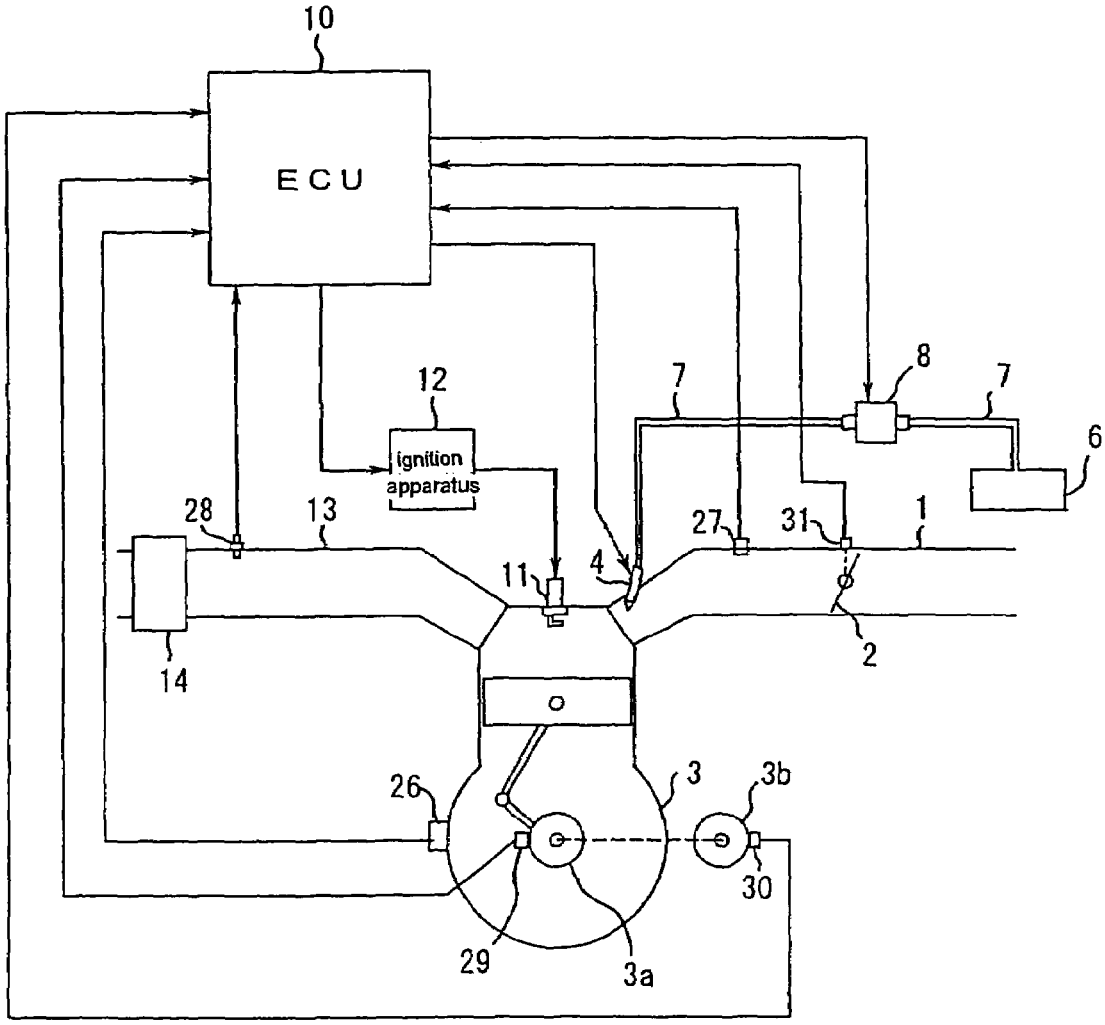
FIG. 1 is a diagram showing an engine control system of an internal combustion engine to which an air-fuel ratio control apparatus according to the invention is applied.

FIG. 1 shows an engine control system of a 4 cycle internal combustion engine mounted to a motorcycle to which an air-fuel ratio control apparatus according to the invention is applied.

An intake pipe 1 of the internal combustion engine is provided with a throttle valve 2, and sucked air of an amount in accordance with an opening degree of the throttle valve 2 is supplied to an intake port of an engine main body 3 via the intake pipe 1. An injector 4 for injecting a fuel is provided to the intake pipe 1 at a vicinity of the intake port of the engine main body 3. A fuel supply pipe 7 is connected from a fuel tank 6 to the injector 4. A plunger type fuel pump 8 is provided to the fuel supply pipe 7. The fuel pump 8 sucks fuel in the fuel tank 6 via the fuel supply pipe 7 on an input side to pressurize to the injector 4 via the fuel supply pipe 7 on an output side by being driven by an ECU (electronic control unit) 10, mentioned later. The injector 4 injects the fuel to the intake port by being driven by the ECU 10.

An exhaust pipe 13 of the internal combustion engine is provided with a catalyzer 14 using a three way catalyst.

Further, an ignition plug 11 is fixedly attached to the engine main body 3, the ignition plug 11 is connected to an ignition apparatus 12 and by issuing an instruction of an ignition timing to the ignition apparatus 12 by ECU 10, spark discharge is brought about at inside of a cylinder of the engine main body 3.

Figure 2:
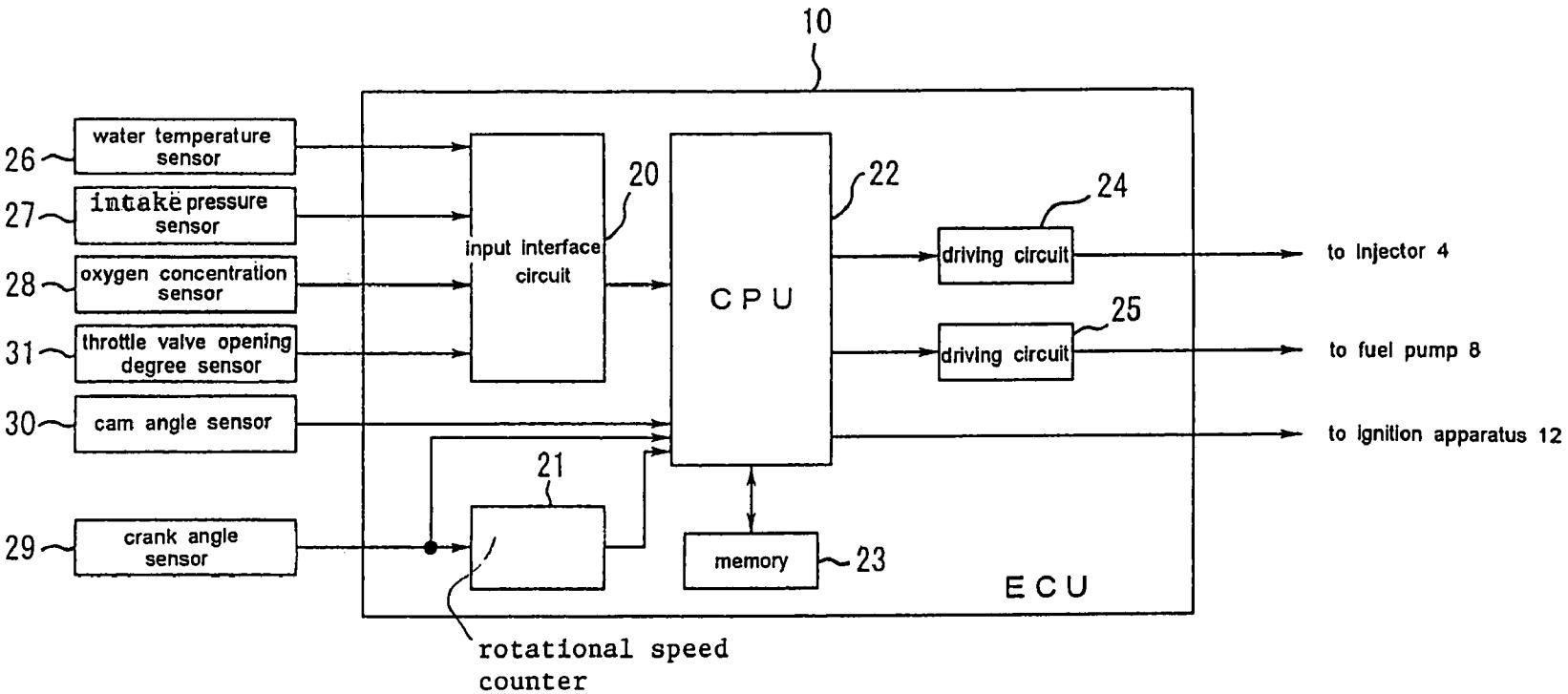
FIG. 2 is a block diagram showing an internal constitution of an ECU in the system of FIG. 1.

As shown by FIG. 2, the ECU 10 is provided with an input interface circuit 20, a rotational speed counter 21, a CPU (central processing unit) 22, a memory 23, and driving circuits 24 and 25.

The input interface circuit 20 is connected with engine operational parameter detecting means of a water temperature sensor 26 for detecting engine cooling water temperature, a intake pressure sensor 27 for detecting a negative pressure at inside of the intake pipe 1, an oxygen concentration sensor 28 provided at the exhaust pipe 13 for detecting an oxygen concentration in exhaust gas, a throttle valve opening degree sensor 31 for detecting the opening degree of the throttle valve 2 and the like. The oxygen concentration sensor 28 is a sensor of a two values outputting type for indicating whether an air-fuel ratio is either of rich and lean in accordance with the oxygen concentration of the oxygen concentration sensor 28 by constituting a threshold by the stoichiometric air-fuel ratio. In place of the sensor of the two values outputting type, an oxygen concentration sensor of an oxygen concentration proportional outputting type may naturally be used.

The rotational speed counter 21 is connected with a crank angle sensor 29 for detecting an engine rotational speed. The crank angle sensor 29 generates a crank pulse at each time of rotating a rotating member, not illustrated, by a predetermined angle (for example, 15 degrees) in cooperation with rotation of a crank shaft 3*a* of the engine main body 3. Further, a cam angle sensor 30 is provided at a vicinity of a rotating member, not illustrated, in cooperation with rotation of a cam shaft 3*b*. The cam angle sensor 30 outputs a TDC signal indicating a compression top dead center of a piston of a representative cylinder or a reference position signal at each time of rotating the crank shaft 3*a* by 720 degrees to the CPU 22.

The rotational speed counter 21 counts a clock pulse outputted from a clock generator, not illustrated, by being reset by the crank pulse outputted from the crank angle sensor 29 and generates a signal indicating an engine rotational speed Ne by counting a number of the generated clock pulses.

The CPU 22 is supplied with respective detection information of the cooling water temperature Tw, the negative pressure PB in the intake pipe, the oxygen concentration O2 and the throttle valve opening degree TH by the sensors 26 through 28 from the input interface circuit 20, information of the engine rotational speed Ne from the rotational speed counter 21 and the TDC signal and the reference position signal from the crank angle sensor 29.

The CPU 22 sets a time point of starting to drive the fuel pump, a time point of starting fuel ignition and an ignition timing in synchronism with the reference position signal and calculates fuel injection time Tout and fuel pump driving time. The time point of starting to drive the fuel pump and the fuel pump drive time are set by a fuel pump driving setting routine, not illustrated. The memory 23 is stored with operational program and data of the CPU 22.

The fuel injection time Tout is basically calculated by using, for example, the following calculating equation.

$$Tout = Ti \times K_{O2}$$

Here, notation Ti designates basic fuel injection time which is an air-fuel ratio reference control value determined by searching a data map from the memory 23 in accordance with the engine rotational speed and the negative pressure in the intake pipe. Notation $K_{O2}$ designates an air-fuel ratio correction coefficient calculated in an air-fuel ratio feedback control based on the output signal of the oxygen concentration sensor 28. The air-fuel ratio correction coefficient $K_{O2}$ is determined in an air-fuel ratio control routine, mentioned later.

Further, in calculating the fuel injection time T out, the fuel injection time Tout is ordinarily determined by adding various corrections of acceleration correction, deceleration correction and the like.

Figure 3:
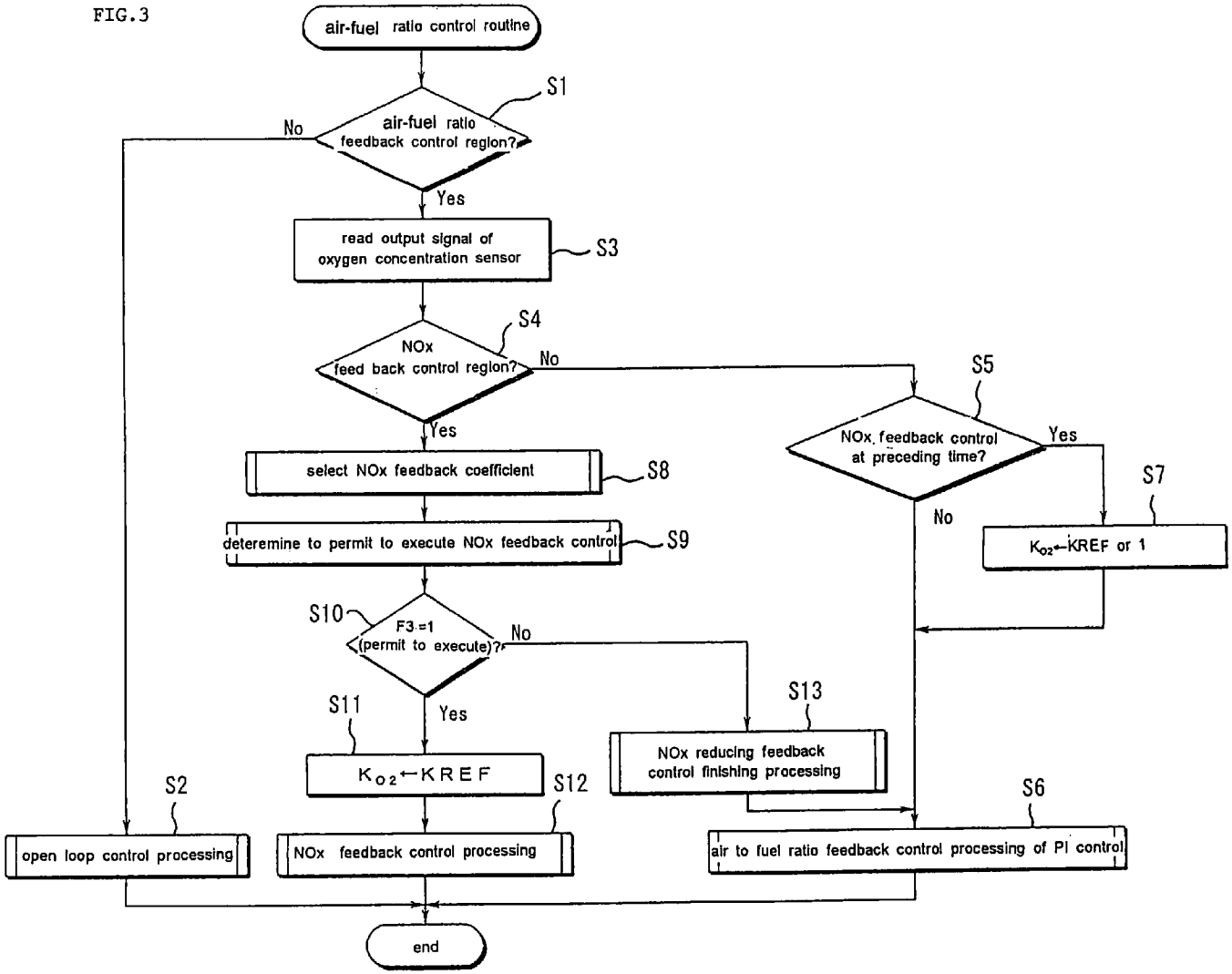
FIG. 3 is a flowchart showing an air-fuel ratio control routine.
Figure 4:
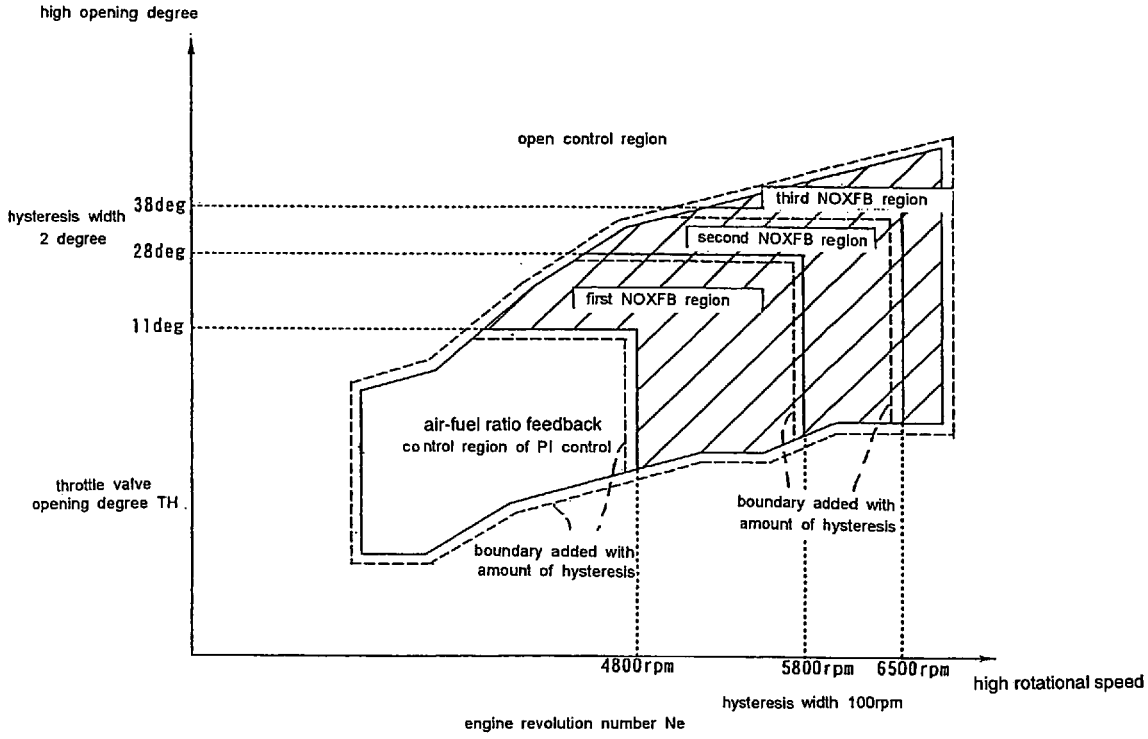
FIG. 4 is a diagram showing an air-fuel ratio feedback region.

The CPU 22 in The ECU 10 executes the air-fuel ratio control routine at a predetermined period. In executing the air-fuel ratio control routine, as shown by FIG. 3, first, the CPU 22 determines whether a control region is an air-fuel ratio feedback control region (step S1). As shown by FIG. 4, the air-fuel ratio feedback control region based on the output signal of the oxygen concentration sensor 28 is set in accordance with the engine rotational speed Ne and the throttle valve opening degree TH. The set information is stored to the memory 23. Therefore, it is determined whether the control region is the air-fuel ratio feedback control region in accordance with data of the air-fuel ratio feedback control region stored to the memory 23.

Further, FIG. 4 shows that there are an air-fuel ratio feedback control region of PI control and an NOx reducing feedback control region in the air-fuel ratio feedback control region. A perturbation control is executed in the NOx reducing feedback control region. As shown by FIG. 4, the NOx reducing feedback control region is further divided into three regions, that is, a first NOXFB region, a second NOXFB region and a third NOXFB region. The reason of dividing the NOx reducing feedback control region into three regions in this way is for executing a control having higher accuracy. That is, an addition value ΔKINC, a subtraction value ΔKDEC of the air-fuel ratio correction coefficient $K_{O2}$, mentioned later, an initial value RFP of time TMINC of a $K_{O2}$ adding state timer, and initial value RFM of time TMDEC of a $K_{O2}$ subtracting state timer are set for every three regions.

Further, amounts of hysteresis are provided at boundaries of the respective regions. That is, when the control region is disposed at outside of the air-fuel ratio feedback control region in determination at the preceding time, in determining whether the control region is disposed in the air-fuel ratio feedback control region successively, a value of the boundary designated by a bold line in FIG. 4 is used as a threshold, and when the control region is disposed at inside of the air-fuel ratio feedback control region in determination at the preceding time, in determining whether the control region is disposed in the air-fuel ratio feedback control region, a value of the boundary designated by a broken line in FIG. 4 is used as a threshold. The same goes with between the air-fuel ratio feedback control region of the PI control and the NOx reducing feedback control region and among the first NOXFB region, the second NOXFB region and the third NOXFB region.

Other than the air-fuel ratio feedback control region, there is an air-fuel ratio open loop control region for controlling the air-fuel ratio regardless of the output signal of the oxygen concentration sensor 28. The CPU 22 executes an open control processing when the air-fuel ratio open loop control region is determined (step S2). In the open control processing, the air-fuel ratio correction coefficient $K_{O2}$ is set to 1, and in calculating the above-described fuel injection time Tout, the fuel injection time Tout is determined by adding other corrections of acceleration correction, deceleration correction and the like except the air-fuel ratio correction coefficient $K_{O2}$.

The CPU 22 reads the output signal of the oxygen concentration sensor 28 when the control region is determined to be the air-fuel ratio feedback control region (step S3), and determines whether the control region is the NOx reducing feedback control region (step S4). The memory 23 is previously stored with data indicating ranges of the respective regions (including hysteresis) as shown by FIG. 4, the NOx reducing feedback control region is determined at step S4 by using the data. That is, when the control region is disposed at inside of the air-fuel ratio feedback control region of PI control in determination at the preceding time, in determining whether the control region is disposed in the NOx reducing feedback control region successively, the value of the boundary shown by the bold line in FIG. 4 is used as the threshold, when the control region is disposed at inside of the NOx reducing feedback control region in determination at the preceding time, in determining whether the control region is disposed in the NOx reducing feedback control region, the value of the boundary shown by the broken line in FIG. 4 is used as the threshold. The threshold is a value immediately before rapidly increasing the NOx amount in exhaust gas both for the engine rotational speed and the throttle valve opening degree.

The CPU 22 determines whether the NOx reducing feedback control is carried out in executing the routine at the preceding time when the control region is determined not to be the NOx reducing feedback control region (step S5). When the NOx reducing feedback control is not carried out in executing the routine at the preceding time, the air-fuel ratio feedback control processing of PI control is carried out (step S6).

When the NOx reducing feedback control is carried out in executing the routine at the preceding time, the NOx reducing feedback control is shifted to the air-fuel ratio feedback control and therefore, the air-fuel ratio correction coefficient $K_{O2}$ is set to a learning value KREF or 1 (step S7), and thereafter, the operation proceeds to step S6 to carry out the air-fuel ratio feedback control processing of PI control. The learning value KREF at step S7 is a value constituted by averaging the air-fuel ratio correction coefficient $K_{O2}$ when the output of the oxygen concentration sensor 28 by an I (integral) term in the PI control is inverted.

The air-fuel ratio feedback control processing of the PI control is publicly known and therefore, a detailed explanation thereof will be omitted here. Generally explaining, when the air-fuel ratio is determined to be, for example, richer than the stoichiometric air-fuel ratio in accordance with the output signal of the oxygen concentration sensor 28, the air-fuel ratio correction coefficient $K_{O2}$ is reduced by an amount of a P (proportional) term and thereafter reduced by an amount of the I term at a predetermined period. Meanwhile, when the air-fuel ratio is determined to be, for example, leaner than the stoichiometric air-fuel ratio in accordance with the output signal of the oxygen concentration sensor 28, the air-fuel ratio correction coefficient $K_{O2}$ is increased by an amount of the P term and thereafter increased by an amount of the I term at the predetermined period.

When the control region is determined to be the NOx reducing feedback control region at step S4, the CPU 22 selects the coefficient for NOx reducing feedback and the timer time (step S8). At step S8, the NOx reducing feedback control region is determined to be any of the first NOXFB region, the second NOXFB region, and the third NOXFB region, and the addition value ΔKINC, the subtraction value ΔKDEC of the air-fuel ratio correction coefficient $K_{O2}$, an initial value RFP of the time TMINC of the $K_{O2}$ adding state timer, and an initial value RFM of time TMDEC of the $K_{O2}$ subtracting state timer are set in accordance therewith. That is, in the case of the first NOXFB region, ΔKINC=ΔKINC1 (for example, 0.03), ΔKDEC=ΔKDEC1 (for example, 0.03), RFP=RFP1 (for example, 250 msec), RFM=RFM1 (for example, 250 msec). In the case of the second NOXFB region, ΔKINC=ΔKINC2 (for example, 0.08), ΔKDEC=ΔKDEC2 (for example, 0.03), RFP=RFP2 (for example, 2500 msec) and RFM=RFM2 (for example, 130 msec). In the case of the third NOXFB region, ΔKINC=ΔKINC3 (for example, 0.08), ΔKDEC=ΔKDEC3 (for example, 0.08), RFP=RFP3 (for example, 80 msec) and RFM=RFM3 (for example, 80 msec).

After selecting the coefficients for NOx reducing feedback and the timer time, it is determined whether to permit to execute the NOx reducing feedback control (step S9).

Figure 5:
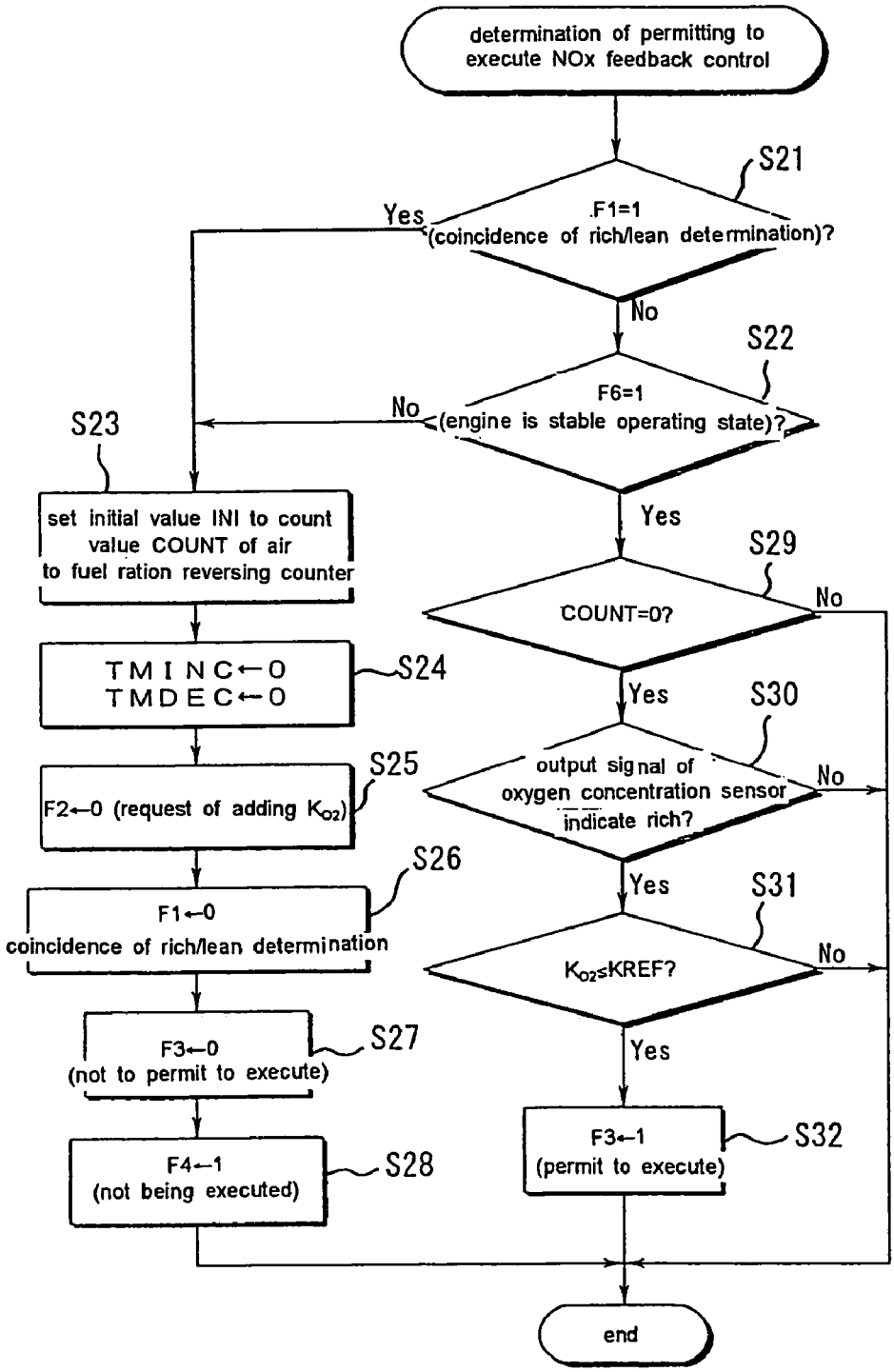
FIG. 5 is a flowchart for determining to permit to execute an NOx feedback control.

In determining to permit execution of the NOx reducing feedback control, as shown by FIG. 5, first, it is determined whether a rich/lean coincidence determining flag F1 is 1 indicating incoincidence (step S21). The rich/lean coincidence determining flag F1 is set in the NOx reducing feedback control processing, mentioned later. That is, F1=0 signifies to detect a state in which when the oxygen concentration sensor 28 is at a level of the output signal indicating rich, the air-fuel ratio correction coefficient $K_{O2}$ is reduced, or detect a state in which when the oxygen concentration sensor 28 is at a level of the output signal indicating lean, the air-fuel ratio correction coefficient $K_{O2}$ is increased. That is, F1=0 signifies that a direction of correcting the air-fuel ratio of a calculated value at a current time of the air-fuel ratio correction coefficient is provided with a predetermined corresponding relationship with the air-fuel ratio determined from the output signal of the oxygen concentration sensor 28. F1=1 signifies to detect a state in which when the oxygen concentration sensor 28 is at a level of the output signal indicating rich, the air-fuel ratio correction coefficient $K_{O2}$ is increased, or detect a state in which when the oxygen concentration sensor 28 is at a level of the output signal indicating lean, the air-fuel ratio correction coefficient $K_{O2}$ is reduced.

When the flag is determined to be F1=0 at step S21, it is determined whether the engine is brought into a stable operating state (step S22). The stable operating state of the engine is determined by detecting that a value of a current time, a value of the preceding time and a value of the time before the preceding time of at least one engine operational parameter of the engine rotational speed Ne, the throttle valve opening degree TH and the negative pressure PB in the intake pipe fall in a predetermined range. Further, each of the value of the current time, the value of the preceding time and the value of the time before the preceding time are detected values of the engine operational parameter detected at timings of a predetermined period. The stable operating state of the engine may be determined by a routine other than the routine and a result thereof may be determined by a stable state flag F6 at step S22.

When the flag is determined to be F1=1 at step S21, or it is determined that the engine is brought into an unstable operating state at step S22, the CPU 22 makes a count value COUNT of an air-fuel ratio reversing counter equal to an initial value INI (for example, 6) (step S23), and makes time TMINC of the $K_{O2}$ adding state timer and time TMDEC of the $K_{O2}$ subtracting state timer equal to 0 (step S24). The air-fuel ratio reversing counter counts down the count value COUNT at each time of reversing the level of the output signal of the oxygen concentration sensor 28 from a level indicating rich to a level indicating lean. Each of the $K_{O2}$ adding state timer and the $K_{O2}$ subtracting state timer is a timer in which when the time value is set, time is measured and the time value is reduced toward 0.

The CPU 22 further makes a $K_{O2}$ addition and subtraction request flag F2 equal to 0 (step S25), makes the rich/lean coincidence determining flag F1 equal to 0 (step S26), makes an NOx reducing feedback control permitting flag F3 equal to 0 (step S27), and makes an NOx reducing feedback control executing flag F4 equal to 1 (step S28). F2=0 indicates a request of adding the air-fuel ratio correction coefficient $K_{O2}$, and F1=0 indicates that the result of detecting the air-fuel ratio by the oxygen concentration sensor 28 and the direction of changing the value at the current time of the air-fuel ratio correction coefficient $K_{O2}$ are provided with the predetermined corresponding relationship as described above. F3=0 indicates not to permit the NOx reducing feedback control, and F4=1 indicates that the NOx reducing feedback control is not actually carried out currently.

When the engine is determined to be brought into the stable operating state at step S22, the CPU 22 determines whether the count value COUNT of the air-fuel ratio reversing counter is 0 (step S29). At step S29, it is determined whether the engine is brought into the stable operating state and a state of corresponding the result of detecting the air-fuel ratio by the oxygen concentration sensor 28 and the direction of changing the air-fuel ratio correction coefficient $K_{O2}$ is continued at least by a number of times of reversing the air-fuel ratio of INI. When the count value COUNT of the air-fuel ratio reversing counter reaches 0, it is determined whether the level of the output signal of the oxygen concentration sensor 28 indicates rich (step S30). Step S30 can also be determined in accordance with a result of setting an oxygen concentration sensor flag F5 to 0 or 1 in the NOx reducing feedback control processing, mentioned later. When the level of the output signal of the oxygen concentration sensor 28 indicates rich, it is determined whether the air-fuel ratio correction coefficient $K_{O2}$ is equal to or smaller than the learning value KREF (step S31). When $K_{O2} \leqq$ KREF, the NOx reducing feedback control permitting flag F3 is set to 1 (step S32), and the NOx reducing feedback control is brought into a state of being permitted to execute thereby.

After executing step S9 of the air-fuel ratio control routine, the CPU 22 determines the result of determining to permit to execute the NOx reducing feedback control by the NOx reducing feedback control permitting flag F3 (step S10). When F3=1, the NOx reducing feedback control is permitted to execute and therefore, the air-fuel ratio correction coefficient $K_{O2}$ is set to the learning value KREF (step S11), thereafter, the NOx reducing feedback control processing is executed (step S12). When F3=0, the NOx reducing feedback control is not permitted to execute and therefore, the NOx reducing feedback control finishing processing is executed (S13). Thereafter, the air-fuel ratio feedback control processing of the PI control is executed by using the air-fuel ratio correction coefficient $K_{O2}$ set in the NOx reducing feedback control finishing processing (step S6).

The NOx reducing feedback control processing at step S12 by the CPU 22 corresponds to controlling means for executing the perturbation control.

Figure 6:
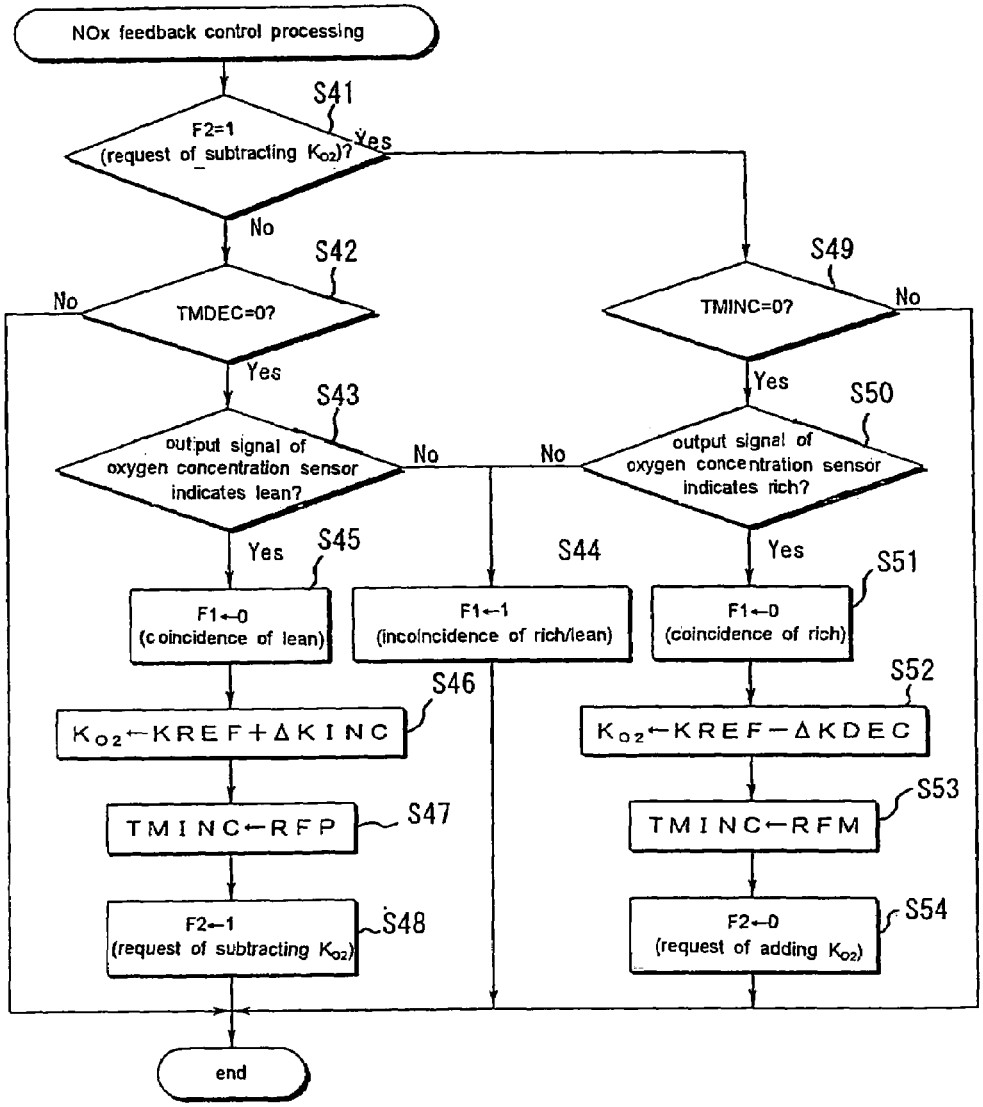
FIG. 6 is a flowchart of an NOx feedback control processing.

In the NOx reducing feedback control processing at step S12, as shown by FIG. 6, first, the CPU 22 determines whether the $K_{O2}$ addition and subtraction request flag F2 is 1 (step S41). When F2=0, this is an occasion of requesting to add the air-fuel ratio correction coefficient $K_{O2}$, that is, an occasion of making the air-fuel ratio rich and it is determined whether the time TMDEC of the $K_{O2}$ subtracting state timer reaches 0 (step S42). When TMDEC>0, the NOx reducing feedback control processing is temporarily finished. When TMDEC=0, subtracting time is finished and therefore, it is determined whether the actual air-fuel ratio is lean from the output signal of the oxygen concentration sensor 28 (step S43). When the actual air-fuel ratio is rich, the result of detecting the air-fuel ratio by the oxygen concentration sensor 28 and the direction of changing the air-fuel ratio correction coefficient $K_{O2}$ are not provided with a corresponding relationship. Therefore, the rich/lean coincidence determining flag F1 is set to 1 (step S44).

On the other hand, when the actual air-fuel ratio is lean, the result of detecting the air-fuel ratio by the oxygen concentration sensor 28 and the direction of correcting the air-fuel ratio by the air-fuel ratio correction coefficient $K_{O2}$ are brought into a coincident corresponding relationship and therefore, the rich/lean coincidence determining flag F1 is set to 0 (step S45). Thereafter, a predetermined addition value ΔKINC is added to the learning value KREF to constitute the air-fuel ratio correction coefficient $K_{O2}$ (step S46). Predetermined time RFP is set to the time TMINC of the $K_{O2}$ adding state timer (step S47), further, the $K_{O2}$ addition and subtraction request flag F2 is set to 1 (step S48).

When the CPU 22 determines F2=1 at step S41, this is an occasion of requesting to subtract the air-fuel ratio correction coefficient $K_{O2}$, that is, an occasion to make the air-fuel ratio lean and it is determined whether the time TMINC of the $K_{O2}$ adding state timer reaches 0 (step S49). When TMINC>0, the NOx reducing feedback control processing is temporarily finished. When TMINC=0, the adding time is finished and therefore, it is determined whether the actual air-fuel ratio is lean from the output signal of the oxygen concentration sensor 28 (step S50). When the actual air-fuel ratio is lean, the result of detecting the air-fuel ratio by the oxygen concentration sensor 28 and the direction of correcting the air-fuel ratio by the air-fuel ratio correction coefficient $K_{O2}$ are brought into an incoincident corresponding relationship and therefore, the rich/lean coincidence determining flag F1 is set to 1 (step S44).

Meanwhile, when the actual air-fuel ratio is rich, the result of detecting the air-fuel ratio by the oxygen concentration sensor 28 and the direction of correcting by the air-fuel ratio correction coefficient $K_{O2}$ are brought into a coincident corresponding relationship and therefore, the rich/lean coincidence determining flag F1 is set to 0 (step S51). Thereafter, a predetermined subtraction value ΔKDEC is subtracted from the learning value KREF to constitute the air-fuel ratio correction coefficient $K_{O2}$ (step S52). Predetermined time RFM is set to the time TMDEC of the $K_{O2}$ subtracting state timer (step S53), further, the $K_{O2}$ addition and subtraction request flag F2 is set to 0 (step S54).

Figure 7:
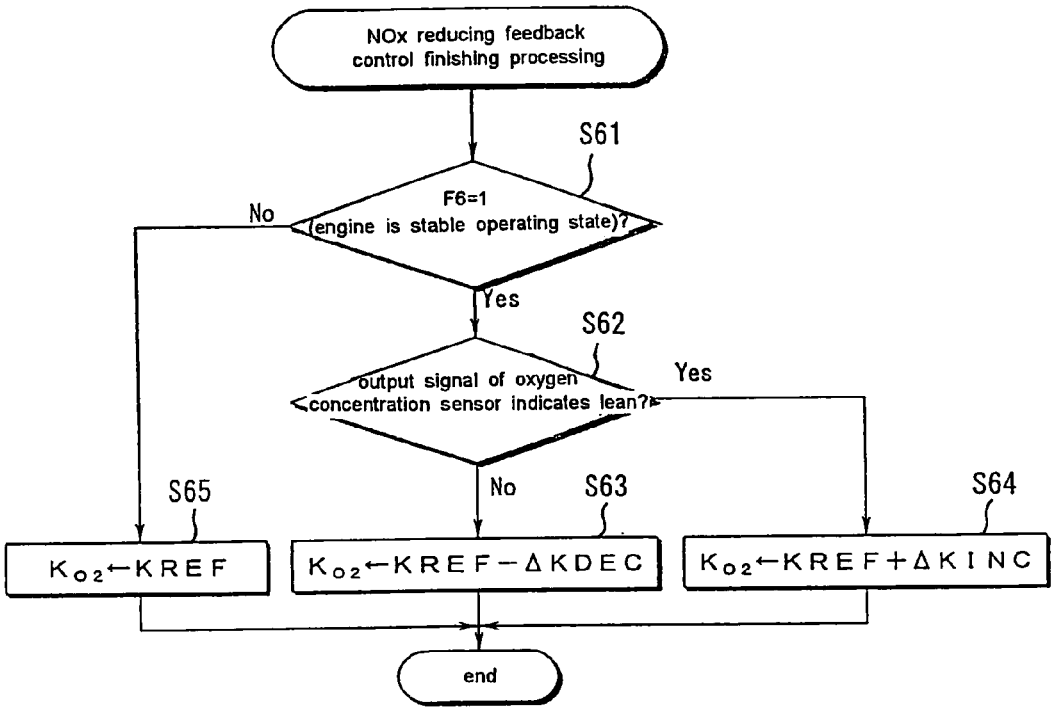
FIG. 7 is a flowchart of an NOx feedback control finishing processing.

In the NOx reducing feedback control finishing processing at step S13, as shown by FIG. 7, first, the CPU 22 determines whether the engine is brought into the stable operating state (step S61). Determination of the stable operating state of the engine is similar to the determination at step S22. When the engine is brought into the stable operating state, it is determined whether the actual air-fuel ratio is lean from the output signal of the oxygen concentration sensor 28 (step S62). When the actual air-fuel ratio is rich, the direction of correcting the air-fuel ratio by the air-fuel ratio correction coefficient $K_{O2}$ becomes lean and therefore, the predetermined subtraction value ΔKDEC is subtracted from the learning value KREF to constitute the air-fuel ratio correction coefficient $K_{O2}$ (step S63). Meanwhile, when the actual air-fuel ratio is lean, the direction of changing the air-fuel ratio correction coefficient $K_{O2}$ becomes rich and therefore, the predetermined addition value ΔKINC is added to the learning value KREF to constitute the air-fuel ratio correction coefficient $K_{O2}$ (step S64). When the engine is not brought into the stable operating state, the air-fuel ratio correction coefficient $K_{O2}$ is set to the learning value KREF (step S65). After executing any of steps 63 through S65, the operation proceeds to the above-described step S6 to carry out the air-fuel ratio feedback control processing of the PI control.

By reflecting the air-fuel ratio correction coefficient $K_{O2}$ set by the air-fuel ratio control routine in this way in calculating the fuel injection time Tout, as a result, the air-fuel ratio of the air-fuel mixture to be supplied to the engine is controlled.

Next, an explanation will be given of an example of operation of the NOx reducing feedback control by executing the air-fuel ratio control routine in reference to FIG. 8.

Figure 8:
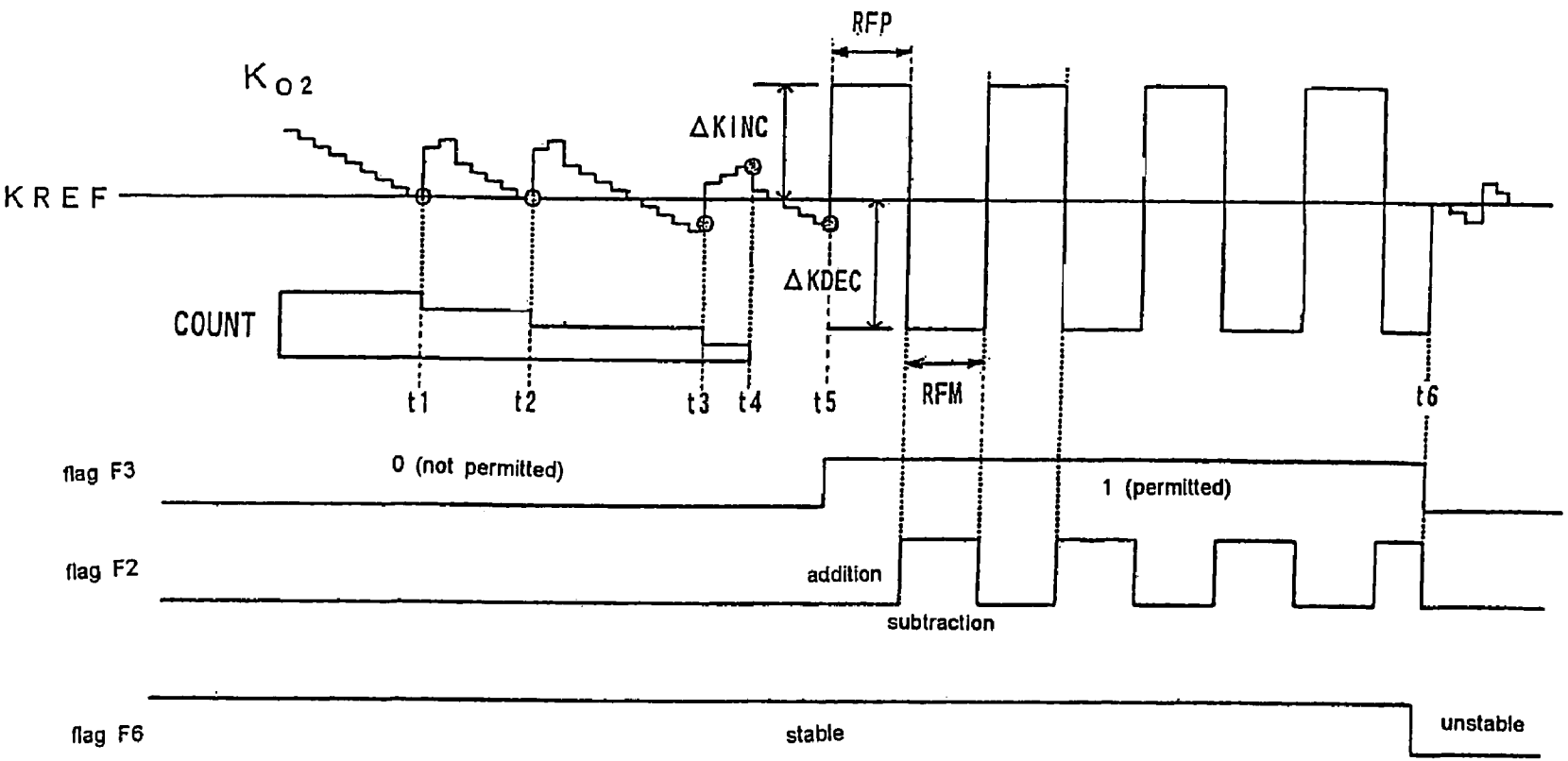
FIG. 8 is a diagram showing an example of operation of an NOx feedback control.

In FIG. 8, during a time period of not permitting the NOx reducing feedback control of F3=0, it is shown that the count value COUNT of the air-fuel ratio reversing counter is reduced in steps finally to 0. During the unpermitted time period, the air-fuel ratio correction coefficient $K_{O2}$ is reduced by the air-fuel ratio feedback control processing of PI control at step S6, the count value COUNT of the air-fuel ratio reversing counter is reduced at each of time points t1, t2, t3, and t4 at which the level of the output signal of the oxygen concentration sensor 28 is reversed from rich to lean of the air-fuel ratio. When the count value COUNT of the air-fuel ratio reversing counter reaches 0 at the time point t4, the air-fuel ratio reversing counter measures reversing of the air-fuel ratio from rich to lean by INI times. At a time point t5 thereafter, the condition of $K_{O2} \leqq$KREF is satisfied at step S31, F3=1 is set at step 32, thereby, the NOx reducing feedback control is permitted to execute. That is, the perturbation control is started from the time point of t5, first, in starting the perturbation control, F2=0 and therefore, $K_{O2}$=KREF+ΔKINC is set at step S46. As a result, the fuel injection time Tout is increased and therefore, the air-fuel ratio of the supplied air-fuel mixture is controlled to be rich and the rich state continues by the predetermined time RFP. After elapse of the predetermined time RFP, at the time point, F2=1 and therefore, the operation proceeds to step S52 to set $K_{O2}$=KREF−ΔKDEC. As a result, the fuel injection time Tout is reduced and therefore, the air-fuel ratio of the supplied air-fuel mixture is controlled to be lean and the leaned state continues by the predetermined time RFM. Therefore, the air-fuel ratio is made to be rich and lean repeatedly in a short period through the perturbation control.

According to the example of operation shown in FIG. 8, at a time point t6 at which the perturbation control is being continued, the state of operating the engine is detected to be unstable and therefore, the stable state flag F6 is reversed from 1 (stable) to 0 (unstable) and the perturbation control is stopped from the time point t6. Further, immediately after the time point t6, the air-fuel ratio correction coefficient $K_{O2}$ is made to be KREF and thereafter changed.

Figure 9:
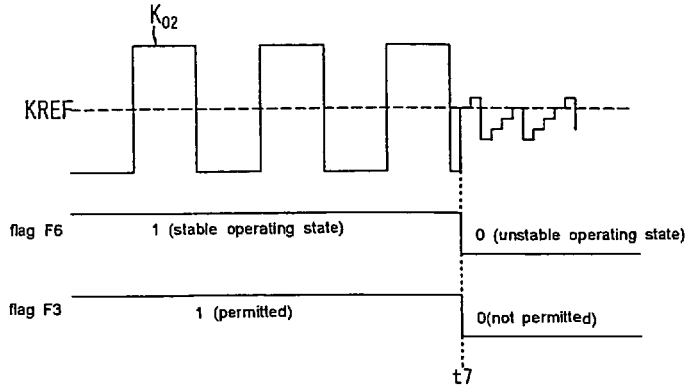
FIG. 9 is a diagram showing an example of operation in finishing an NOx feedback control.

FIG. 9 shows a change in the air-fuel ratio correction coefficient $K_{O2}$ when the perturbation control is shifted to the air-fuel ratio feedback control since the state of operating the engine is detected to be unstable. The stable state flag F6 is reversed from 1 to 0, at a time point t7 shown in FIG. 9, the air-fuel ratio correction coefficient $K_{O2}$ is made to be KREF at step S65 and thereafter, the air-fuel ratio feedback control processing is started. By the air-fuel ratio feedback control processing of PI control, thereafter, the air-fuel ratio correction coefficient $K_{O2}$ is changed in steps.

Figure 10:
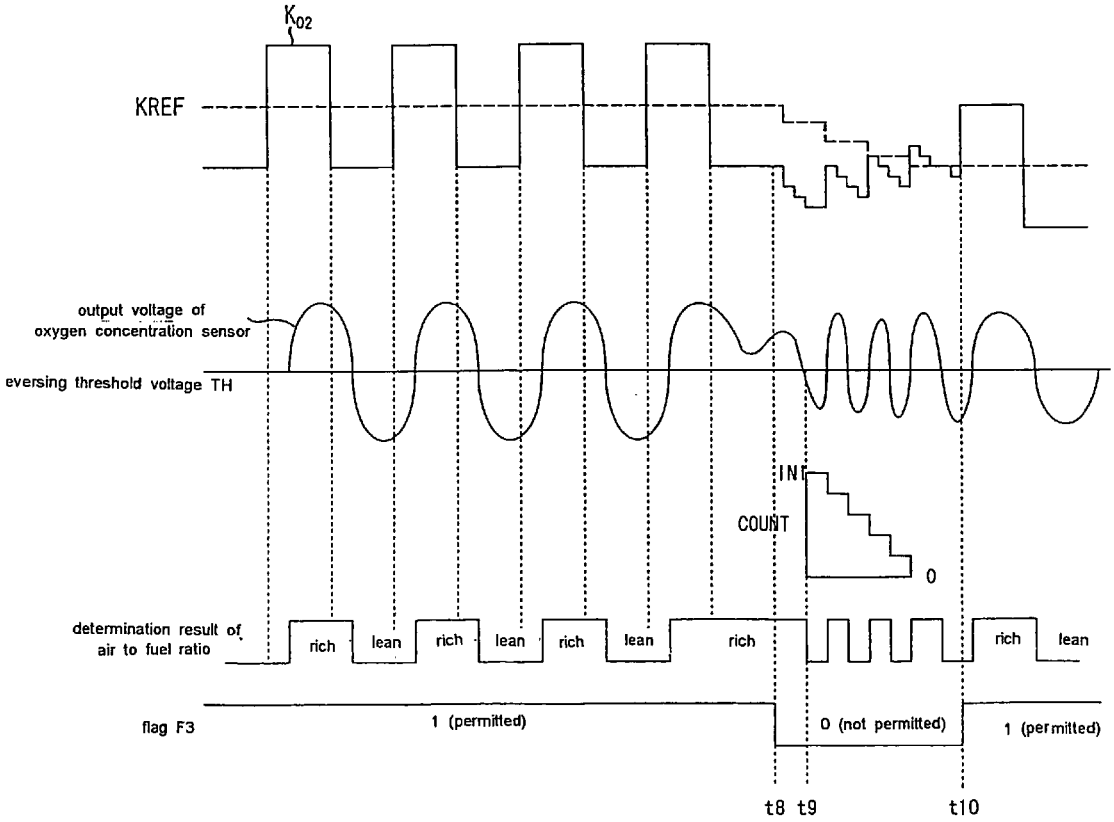
FIG. 10 is a diagram showing an example of operation in finishing an NOx feedback control.

Further, when F1=1, that is, the state in which the result of detecting the air-fuel ratio by the oxygen concentration sensor 28 and the direction of correcting the air-fuel ratio by the air-fuel ratio correction coefficient $K_{O2}$ are brought into the inconsistent corresponding relationship is determined at step S21 in the perturbation control, the perturbation control is stopped. In the case in which even when the actual air-fuel ratio is on the lean side during the perturbation control, the result of detecting the air-fuel ratio by the oxygen concentration sensor 28 indicates the rich side, as shown by FIG. 10, the air-fuel ratio correction coefficient $K_{O2}$, the learning value KREF, the output voltage of the oxygen concentration sensor 28, rich/lean determination and the flag F3 are changed. At a time point t8 shown in FIG. 10, although the actual air-fuel ratio by the perturbation control is on the lean side, the result of detecting the air-fuel ratio by the oxygen concentration sensor 28 indicates the rich side and therefore, at step S44, the flag F1 is set to 1, as a result, the flag F3 is reversed from 1 to 0 at step S27 and the perturbation control is not permitted to execute. Therefore, in place of the perturbation control, the NOx reducing feedback control finishing processing at step S13 is executed. At the time point, the air-fuel ratio correction coefficient $K_{O2}$ is set to KREF−ΔKDEC at step S63 and thereafter, the air-fuel ratio feedback control of PI control is immediately started. That is, the value of the air-fuel ratio correction coefficient $K_{O2}$ at the time point of stopping the perturbation control is used as it is. As a result, the air-fuel ratio of the supplied air-fuel mixture becomes a lean state and therefore, the air-fuel ratio correction coefficient $K_{O2}$ is further reduced in steps. At a time point t9 shown in FIG. 10, the output voltage of the oxygen concentration sensor 28 becomes lower than the reversing threshold voltage TH in correspondence with the stoichiometric air-fuel ratio and the count value COUNT of the air-fuel ratio reversing counter starts counting. The learning value KREF is the value constituted by averaging the air-fuel ratio correction coefficient $K_{O2}$ in reversing the output of the oxygen concentration sensor 28 as described above and therefore, the learning value KREF is gradually lowered in reversing from lean to rich. In the example shown in FIG. 10, the perturbation control is started again at a time point t10 after the count value COUNT of the air-fuel ratio reversing counter reaches 0.

Further, in the case in which although the actual air-fuel ratio is on the rich side during the perturbation control, the result of detecting the air-fuel ratio by the oxygen concentration sensor 28 indicates the lean side, the air-fuel ratio correction coefficient $K_{O2}$, the learning value KREF and the output voltage of the oxygen concentration sensor 28 are constituted by waveform patterns reverse to those of the example shown in FIG. 10.

According to the internal combustion engine mounted on the vehicle using such an air-fuel ratio control apparatus, even when the control region is disposed in the air-fuel ratio feedback control region, in the case in which the control region is disposed at the comparatively low load and low engine rotational speed region, the air-fuel ratio feedback control of PI control is carried out and even when the control region is disposed in the air-fuel ratio feedback control region, in the case in which the control region is disposed in the high load and high engine rotational speed region, the perturbation control is carried out for reducing NOx. This is based on the fact that the amount of exhausting NOx is rapidly increased in the high load and high engine rotational speed region. Further, at the region, in comparison with the low load and the low engine rotational speed region, vibration of the vehicle by carrying out the perturbation control is masked by vibration by increasing the engine rotational speed and therefore, an influence on the operability of the driver by the perturbation control can be minimized. That is, in the low load and the low engine rotational speed region in which the amount of exhausting NOx is small, excellent stable operability is achieved by the air-fuel ratio feedback control of PI control, further, in the high load and high engine rotational speed region in which the amount of exhausting NOx is large, NOx in the exhaust gas can sufficiently be cleaned by the three way catalyst while minimizing a deterioration in the operability by the perturbation control. In the perturbation control, for example, the air-fuel ratio is periodically vibrated to the rich side and to the lean side centering on the stoichiometric air-fuel ratio and therefore, there is produced a state in which the uncombusted component in the rich exhaust gas and excess oxygen in the lean exhaust gas are mixed and therefore, not only cleaning of CO, HC in the exhaust gas by the three way catalyst but also cleaning of NOx are carried out further actively.

Further, although according to the above-described embodiment, the air-fuel ratio control is executed by adjusting the fuel injection amount to the engine in accordance with the air-fuel ratio correction coefficient $K_{O2}$, the invention is applicable to an air-fuel ratio control apparatus of a system of adjusting an amount of air supplied to the engine.

Although according to the above-described embodiment, an explanation has been given of the case of applying the invention to a motorcycle, the invention is applicable also to other vehicle mounted with an engine of so-to-speak light 4-wheel vehicle, 3-wheel vehicle or the like.

Further, although according to the above-described embodiment, the target air-fuel ratio is the stoichiometric air-fuel ratio, the invention is not limited thereto. The target air-fuel ratio may differ between the case of the air-fuel ratio feedback control of PI control and the case of the NOx reducing feedback control.

Further, although the respective regions shown in FIG. 4 are determined in accordance with the engine rotational speed Ne and the throttle valve opening degree TH, vehicle speed may be used in place of the engine rotational speed Ne, further, the parameter indicating the engine load of the negative pressure in the intake pipe, or the intake air amount to the engine or the like can be used in place of the throttle valve opening degree TH.

As described above, according to the invention, the perturbation control is executed in the state in which operation of the engine is stable even in the air-fuel ratio feedback control region and therefore, a reduction in NOx in exhaust gas can be achieved by the three way catalyst while maintaining the excellent operating state. Further, the invention can use the basic hardware constitution of the air-fuel ratio control apparatus as it is and therefore, an increase in cost can be restrained.

What is claimed is:

1. An air-fuel ratio control apparatus including an oxygen concentration sensor for generating an output signal depending on an oxygen concentration in exhaust gas at an exhaust pipe of an internal combustion engine, for controlling an air-fuel ratio of an air-fuel mixture supplied to said internal combustion engine in accordance with the output signal of said oxygen concentration sensor to a target air-fuel ratio by a feedback control, said air-fuel ratio control apparatus comprising:

detecting means for detecting a predetermined high load and high rotation operating state of said internal combustion engine to generate a detecting signal; and controlling means for executing a perturbation control for vibrating the air-fuel ratio periodically to a rich side and a lean side centering on the target air-fuel ratio in accordance with the output signal of said oxygen concentration sensor when the detecting signal is generated.

2. The air-fuel ratio control apparatus according to claim 1, wherein said detecting means includes engine rotational speed detecting means for detecting an engine rotational speed of said internal combustion engine and throttle valve opening degree detecting means for detecting an opening degree of a throttle valve of said internal combustion engine; and detects the predetermined high load and high rotation operating state in accordance with respective detecting values of said engine rotational speed detecting means and said throttle valve opening degree detecting means.

3. The air-fuel ratio control apparatus according to claim 2, wherein said detecting means has hysteresis to the respective detecting values of said engine rotational speed detecting means and said throttle valve opening degree detecting means to detect the predetermined high load and high rotation operating state.

4. The air-fuel ratio control apparatus according to claim 1, wherein said controlling means executes the air-fuel ratio feedback control by calculating an air-fuel ratio correction coefficient in accordance with the output signal of said oxygen concentration sensor, the air-fuel ratio correction coefficient being a coefficient for correcting an amount of fuel to be injected to supply to said internal combustion engine; and in the perturbation control, alternately executes calculation of the air-fuel ratio correction coefficient by adding a predetermined addition value to a reference value and calculation of the air-fuel ratio correction coefficient by subtracting a predetermined subtraction value from the reference value.

5. The air-fuel ratio control apparatus according to claim 1 or 4, wherein said controlling means includes air-fuel ratio detecting means for detecting the air-fuel ratio of the air-fuel mixture supplied to said internal combustion engine in accordance with the output signal of said oxygen concentration sensor; and in the case of generating the detecting signal, starts the perturbation control when it is detected that an operating state of said internal combustion engine is stable, reversing of the air-fuel ratio detected by said air-fuel ratio detecting means from the rich side to the lean side relative to the target air-fuel ratio is executed by a predetermined number of times or more, the air-fuel ratio detected by said air-fuel ratio detecting means is richer than the target air-fuel ratio, and the air-fuel ratio correction coefficient is equal to or lower than the reference value.

6. The air-fuel ratio control apparatus according to claim 1 or 4, wherein said controlling means stops the perturbation control and executes the air-fuel ratio feedback control when it is detected that an operating state of said internal combustion engine becomes unstable, or in calculating the air-fuel ratio correction coefficient, a direction of changing the air-fuel ratio correction coefficient calculated at a current time and the air-fuel ratio detected by said air-fuel ratio detecting means are not provided with a predetermined corresponding relationship, in the perturbation control.

7. The air-fuel ratio control apparatus according to claim 6, wherein in a case of executing the air-fuel ratio feedback control when it is detected that the operating state of said internal combustion engine becomes unstable in the perturbation control, said controlling means sets the air-fuel ratio correction coefficient to the reference value, and in a case of executing the air-fuel ratio feedback control when it is detected that the direction of correcting the air-fuel ratio of the calculated value of the air-fuel ratio correction coefficient at the current time and the air-fuel ratio detected by said air-fuel ratio detecting means are not provided with the predetermined corresponding relationship, said controlling means uses the air-fuel ratio correction coefficient of a value at the time point as it is.

* * * * *